United States Patent [19]

Decker

[11] 4,137,974

[45] Feb. 6, 1979

[54] HYDRAULICALLY DRIVEN KELLY CROWD

[75] Inventor: Raymond E. Decker, Riverside, Calif.

[73] Assignee: Smith International, Inc., Newport Beach, Calif.

[21] Appl. No.: 757,219

[22] Filed: Jan. 6, 1977

[51] Int. Cl.[2] ..... B23Q 5/027

[52] U.S. Cl. ..... 173/147; 173/151; 173/87

[58] Field of Search ..... 173/1, 147, 149, 151, 173/81, 85, 86, 87; 175/162

[56] References Cited

U.S. PATENT DOCUMENTS

| | | | |
|---|---|---|---|
| 3,717,205 | 2/1973 | Wilderman | 173/147 |
| 3,719,238 | 3/1973 | Campbell et al. | 173/147 |
| 3,830,315 | 8/1974 | Love | 173/151 |
| 3,867,989 | 2/1975 | Hisey et al. | 173/147 |
| 3,949,818 | 4/1976 | Russell | 173/85 |
| 3,987,856 | 10/1976 | Carl et al. | 173/149 |
| 4,044,577 | 8/1977 | Horlacher | 70/49 |

FOREIGN PATENT DOCUMENTS

| | | | |
|---|---|---|---|
| 1453482 | 8/1966 | France | 175/162 |

*Primary Examiner*—Robert A. Hafer

[57] ABSTRACT

A vertical drill rig is provided with a hydraulic crowd mechanism for crowding down a drive kelly having a rotating drilling tool supported from the lower end thereof.

The crowd mechanism includes a drum having first and second cables wound in opposite senses thereon. The drum is rotated by a hydraulic motor driven by pressure regulated fluid supplied by an accumulator charged with fluid received from a hydraulic pump. The cables couple the drive kelly to the rig such that, when the hydraulic motor rotates the drum in a given direction, the first cable is paid out to lower the drive kelly while the second cable is simultaneously taken up to crowd down the drive kelly relative to the rig. Such a construction and arrangement provides a substantially constant crowd down force on the rotating drilling tool irrespective of its vertical rate of penetration into the earth.

13 Claims, 29 Drawing Figures

49
57
23
21
20
20
18
113
78
77
80
81
10
37
30
28
70
46
75
25
70
113
117
15
13
102
61
62
29
11
108
12
17

67
66
65
79
79
76
68
60
63
64
30
58
109
53
56
53
55
47
44
45
43
48
54
41
43
36
33
40
113
87
113
31
42
42
73

FIG. 11.
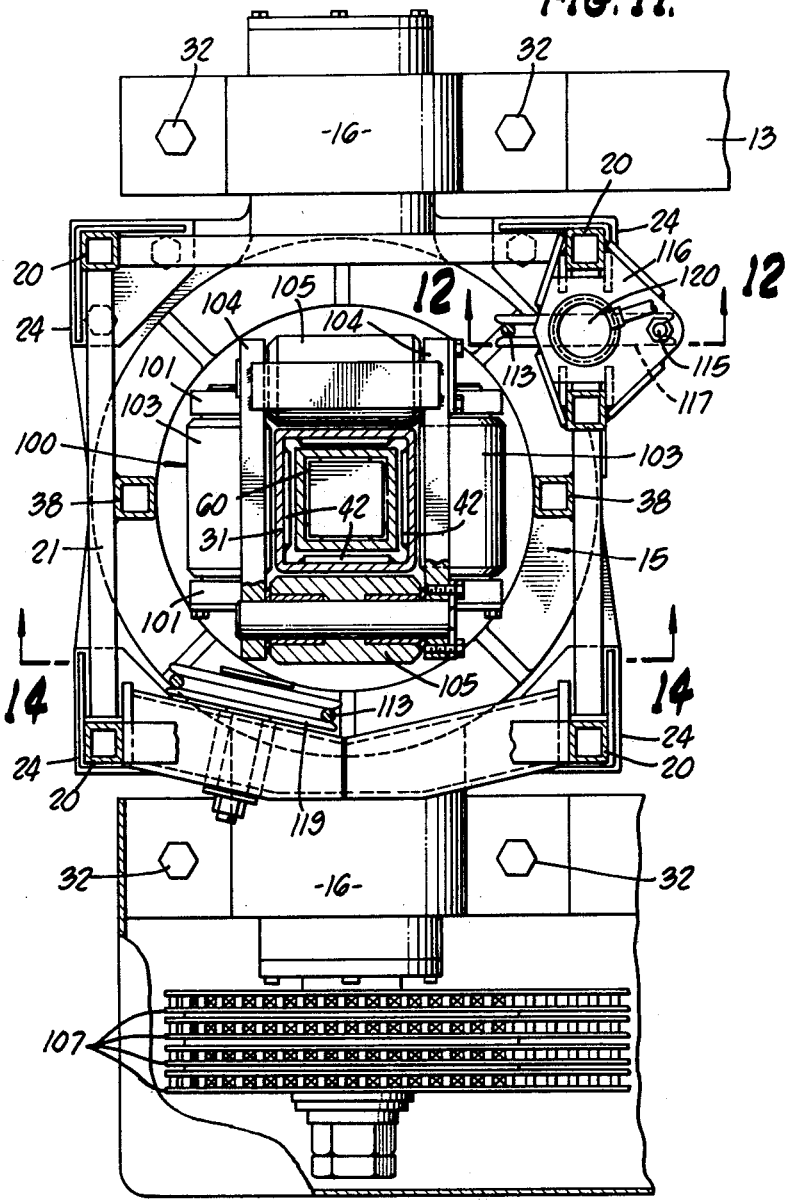
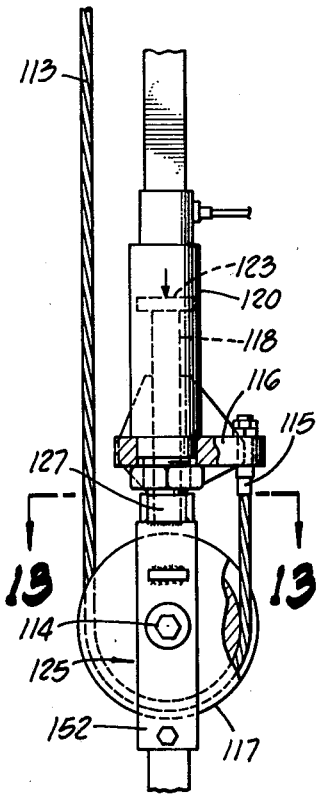
FIG. 12.
FIG. 14.
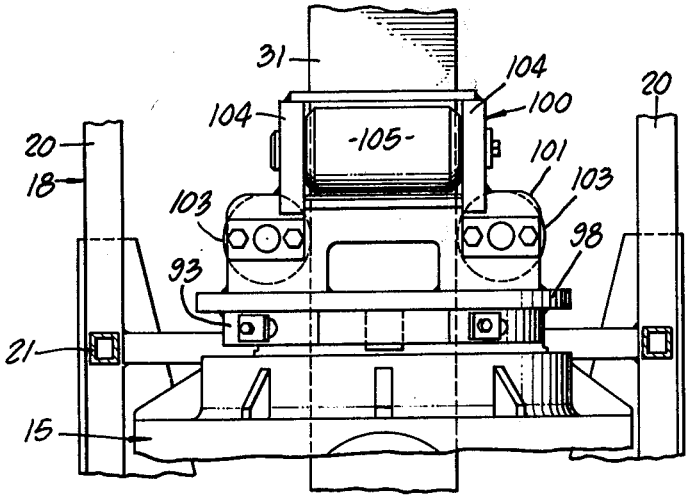
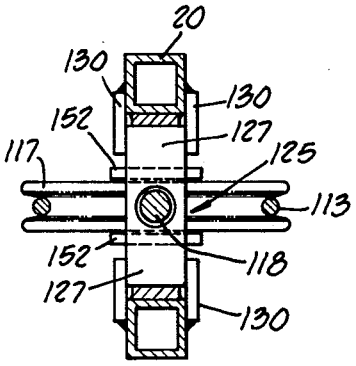
FIG. 13.

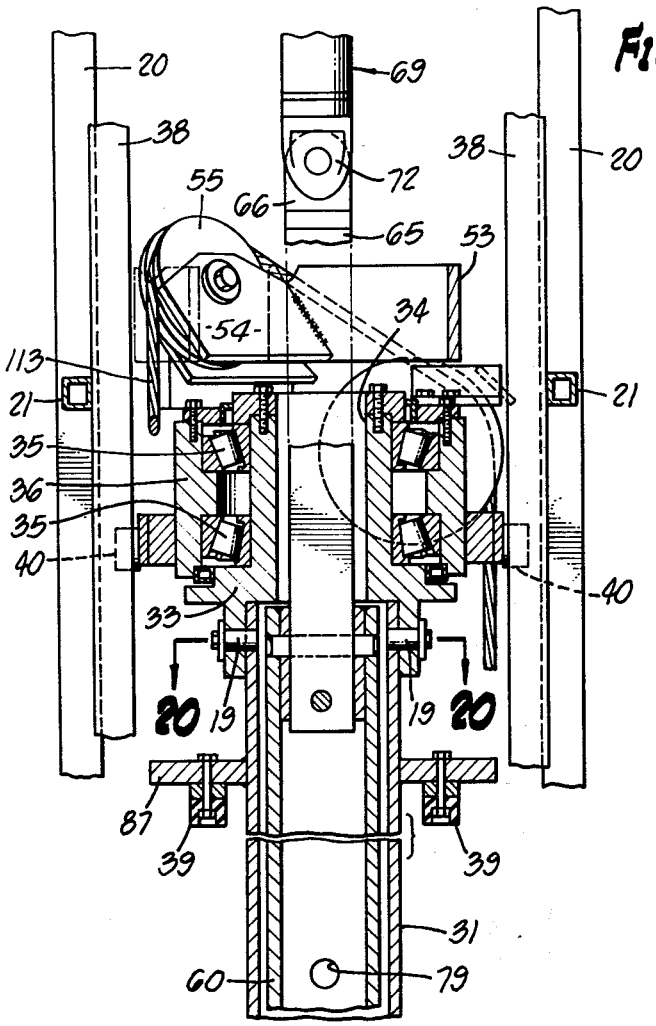
FIG. 19.
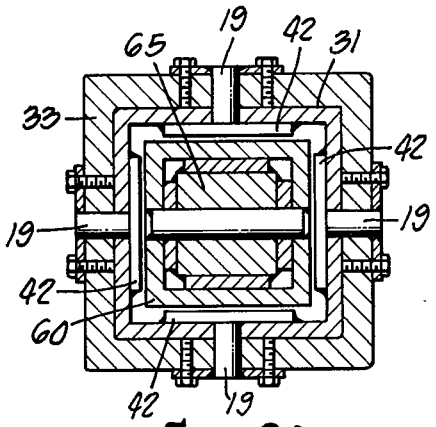
FIG. 20.
FIG. 22.
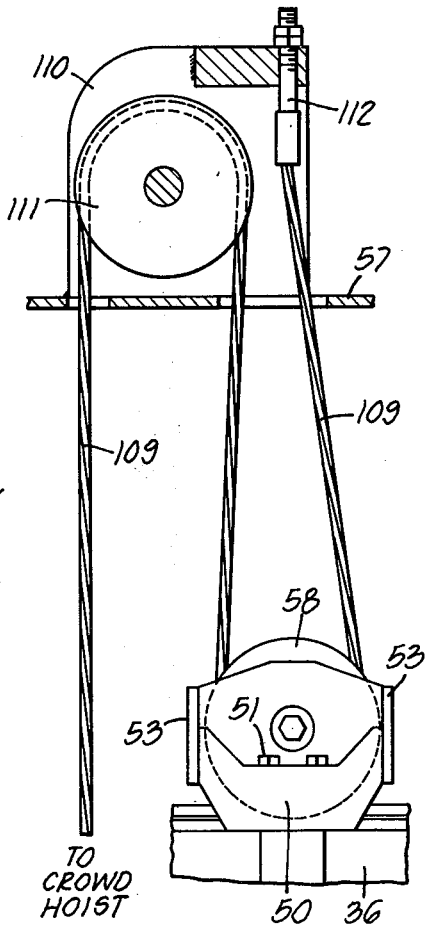
FIG. 21.
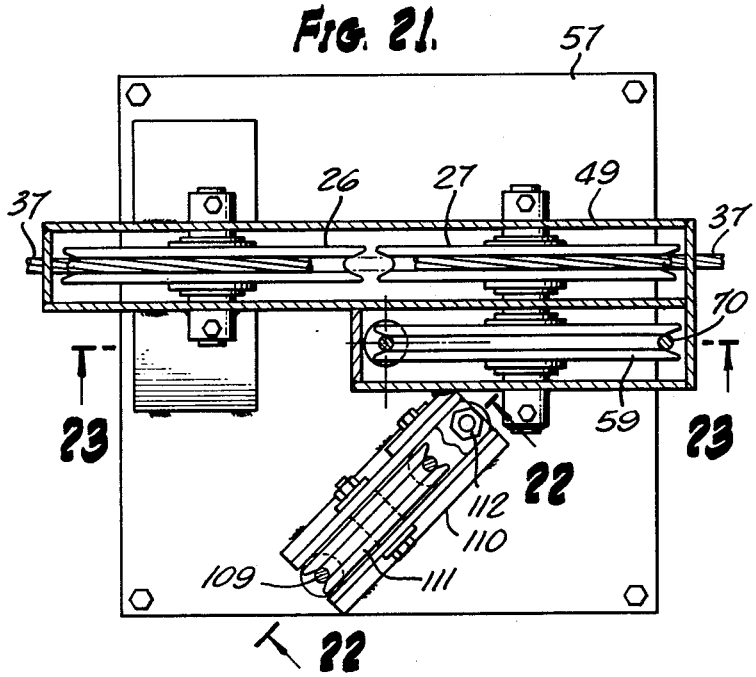

FIG. 25.
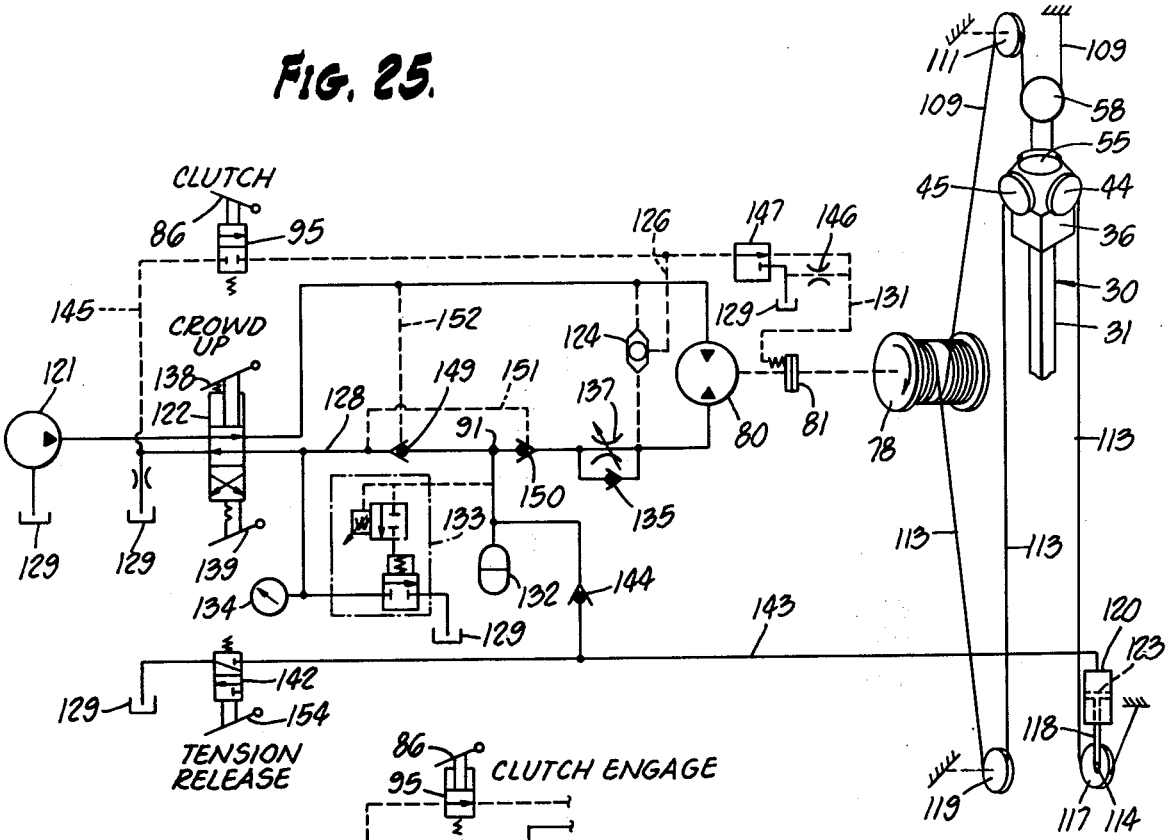
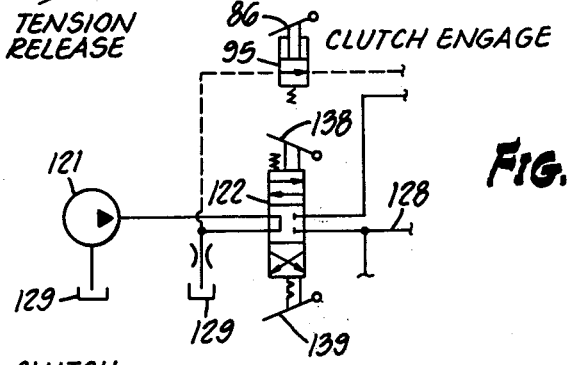
FIG. 27.
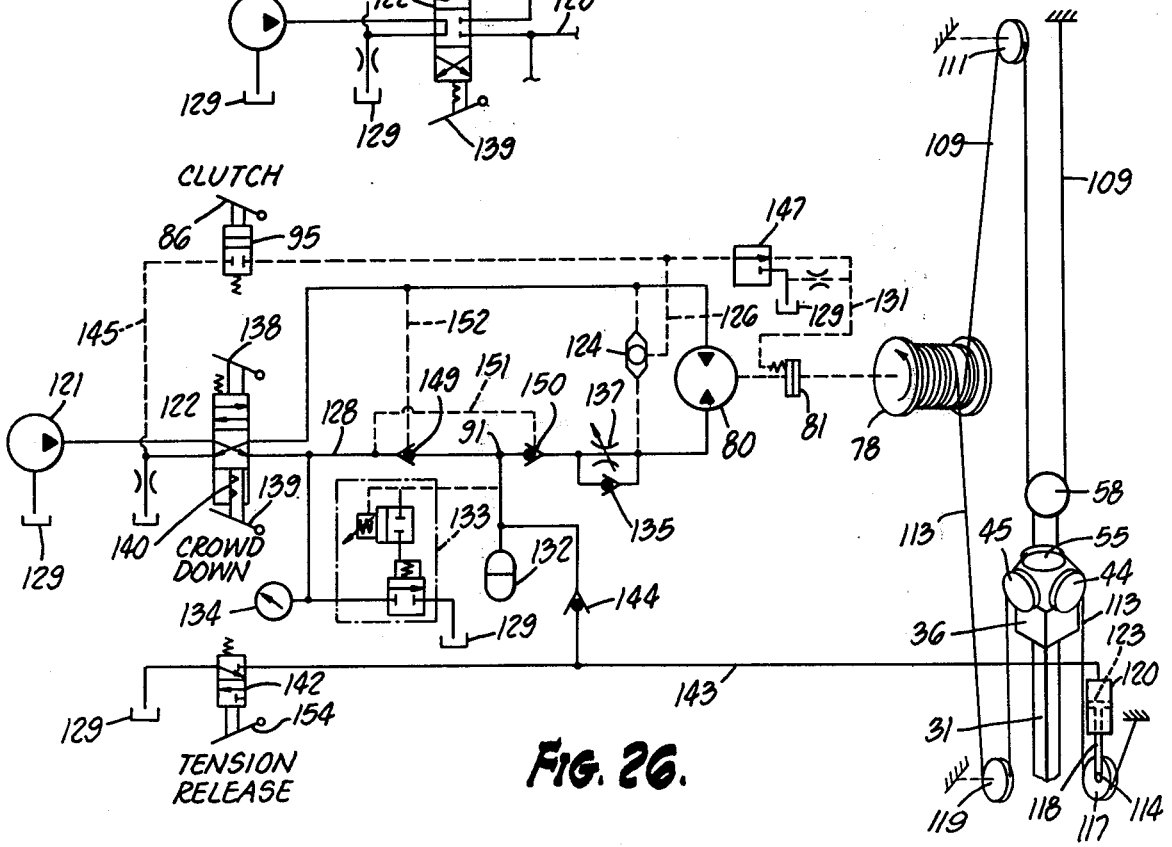
FIG. 26.

HYDRAULICALLY DRIVEN KELLY CROWD

BACKGROUND OF THE INVENTION

This invention relates to a vertical drilling rig having a drive kelly for a drilling tool supported therefrom and more particularly to such a drilling rig which includes a hydraulically driven crowd for the drive kelly.

In vertical drill rigs it has long been the established practice to utilize a drive kelly having a drilling tool supported from its lower end, and at some point along its vertical length the drive kelly passes through an opening in a rotary table having a roller drive unit supported thereon. The rotary table is drivingly rotated for imparting a rotating movement through the roller drive unit to the drive kelly and thus the drilling tool. If the hole being drilled is very shallow, or the formation is very soft, the downward vertical drive of the drilling tool can be accomplished by gravity alone. That is, the combined weight of the drilling tool and the drive kelly are sufficient to drive the drilling tool downward at the necessary penetration rate of travel.

In many instances, however, when the depth of the hole becomes greater or the formation of the ground being cut is relatively hard, then the mere weight of the equipment is no longer sufficient to accomplish the drilling action at a satisfactory penetration rate. It then becomes necessary, or at least advantageous, to accelerate the downward travel of the drilling tool by "crowding" the kelly.

It has heretofore been known to utilize a crowd mechanism having a positive drive such that a powered downward movement of the crowd mechanism is fully and directly imparted to the drive kelly and hence to the drilling tool. Another known type of crowd mechanism is the friction crowd in which another member is placed in longitudinal sliding engagement with the drive kelly and is moved downwardly in order to at least partially transmit its downward movement through the drive kelly to the drilling tool. A drive kelly utilizing a type of friction crowd has been disclosed in U.S. Pat. No. 3,987,856.

In drilling relatively deep holes such as 100 feet or more, it is generally the practice to utilize either a double kelly or a triple kelly. Thus the kelly is provided with multiple members which have a longitudinal telescopically collapsed position in which they are concentrically arranged, or which any be longitudinally extended so that each member overlaps a small portion of the length of the next.

It will be evident that the arrangement of the vertical drilling rig, including its rotary table, drive kelly and crowd mechanism, generates a rather complex problem when an effort is made to achieve maximum drilling speeds, maximum depth of hole to be cut, and at the same time maintaining the original cost of equipment as well as the maintenance expense thereof at minimum levels.

It is therefore the purpose and object of the present invention to provide a crowd mechanism for a drive kelly of a vertical drilling rig which has advantages not obtainable with previously known types of crowd mechanims.

Another object of the present invention is to provide a hydraulically driven kelly crowd mechanism for a vertical drilling rig which provides for the crowd load applied on the drive kelly to remain substantially constant while enabling the vertical penetration rate of the rotating drilling tool supported from the lower end of the drive kelly to automatically vary in accordance with the hardness of the formation of the earth encountered during the drilling of a hole.

Another object of the present invention is to provide from crowding a drill kelly having a drilling tool on the lower end thereof by providing apparatus for automatically and simultaneously lowering and pulling down the swivel head of the drive kelly at a rate which varies in accordance with the variation of the hardness of the formation of the earth being drilled by the drilling tool.

With these and other objects in view, the invention consists in the construction, arrangement, and combination of the various parts of the device whereby the objects contemplated are attained as hereinafter set forth, pointed out in the appended claims and illustrated in the accompanying drawings.

SUMMARY OF THE INVENTION

According to one feature of the invention a hydraulic drive system is used to apply a constant force on a drilling tool being used to drill a hole in the earth while permitting the drilling tool to advance downwardly at a variable penetration rate determined by the hardness of the earth encountered at any given instant.

According to another feature of the invention, a cable loop is effectively used to drive the raising and lowering movement of a drive kelly having a drilling tool supported from the lower end thereof.

According to a third feature of the invention a novel pulley arrangement is provided on the swivel head which supports the drive kelly so that a cable may be used to produce a balanced downward driving force for crowding the drive kelly.

DRAWING SUMMARY

FIG. 11 is a cross-sectional view of the derrick as taken on the line 11—11 of FIG. 8A showing the roller drive unit;

FIG. 12 is an elevation view taken on the line 12—12 of FIG. 11 showing the cable tensioner for the kelly crowd;

FIG. 13 is a plan view taken on line 13—13 of FIG. 12;

FIG. 14 is an elevation view taken on line 14—14 of FIG. 11 showing the derrick support housing and the rotary table housing with the roller drive unit mounted on the top thereof;

FIG. 19 is a vertical sectional view of the swivel head taken on the line 19—19 of FIG. 17;

FIG. 20 is a cross-sectional view taken on line 20—20 of FIG. 19 showing the attachment of the spindle to the top of the outer kelly member;

FIG. 21 is a plan view taken on line 21—21 of FIG. 8B showing the pulleys mounted on the crown plate of the derrick;

FIG. 22 is a view taken on line 22—22 of FIG. 21 showing the pulley and cable arrangement for raising and lowering the swivel head on the outer kelly member;

FIG. 25 is a schematic diagram of the hydraulic system associated with the kelly crowd mechanism and showing the latter in its "crowded up" position;

FIG. 26 is a schematic diagram of the hydraulic system associated with the kelly crowd mechanism showing the latter in its "crowded down" position; and FIG. 27 is a partial schematic diagram of the clutch engaging feature of the hydraulic system.

PREFERRED EMBODIMENT

Figure 1:
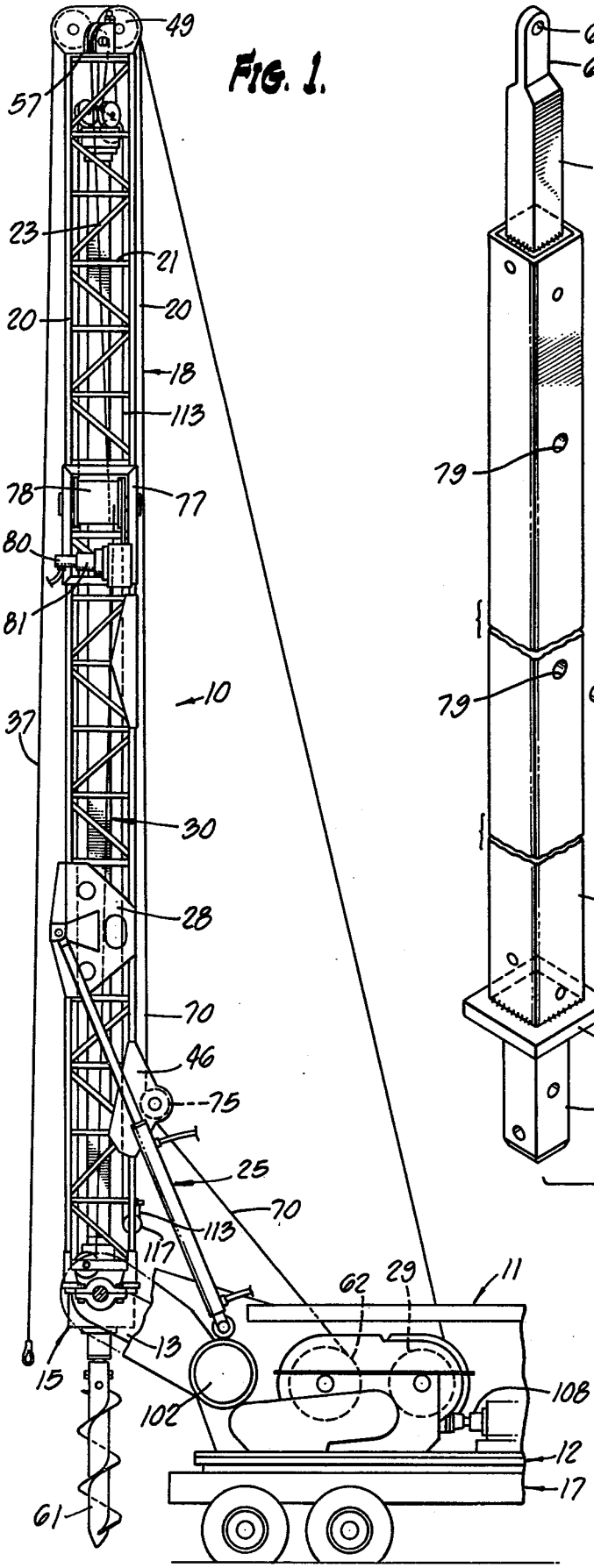
FIG. 1 is an overall side elevation view of a vertical drilling rig incorporating the hydraulically driven kelly crowd mechanism of the present invention.

Referring to the drawings, an overall view of a vertical drilling rig 10 embodying the crowd mechanism of the present invention is shown in FIG. 1. The drilling rig 10 includes a main frame 11 mounted on a turntable assembly 12 which is supported on the bed of a truck 17. The main frame 11 has a pair of cantilever arms 13 extending angularly upwardly from either side of the front end thereof. A rotary table housing 15 having a derrick 18 attached on the upper end thereof is pivotally supported on the outer ends of the arms 13. The derrick 18 comprises four elongated steel square tube corner members 20 which are connected together by spaced horizontal struts 21 and diagonal struts 23.

A pair of hydraulic rams 25, one on each side of the derrick 18, have their lower ends pivotally connected to the sides of the main frame 11 and their upper ends pivotally connected to a supporting brace 28 attached on the side of the derrick 18 above rotary table housing 15. The hydraulic rams 25 are operable under manual control of the operator. Thus, when the drill rig 10 is set up to drill a hole, the housing 15 is pivoted on the arms 13 by use of the hydraulic rams 25 to raise the derrick 18 from a horizontal position on the main frame 11 to the upright position shown in FIG. 1.

Figure 2:
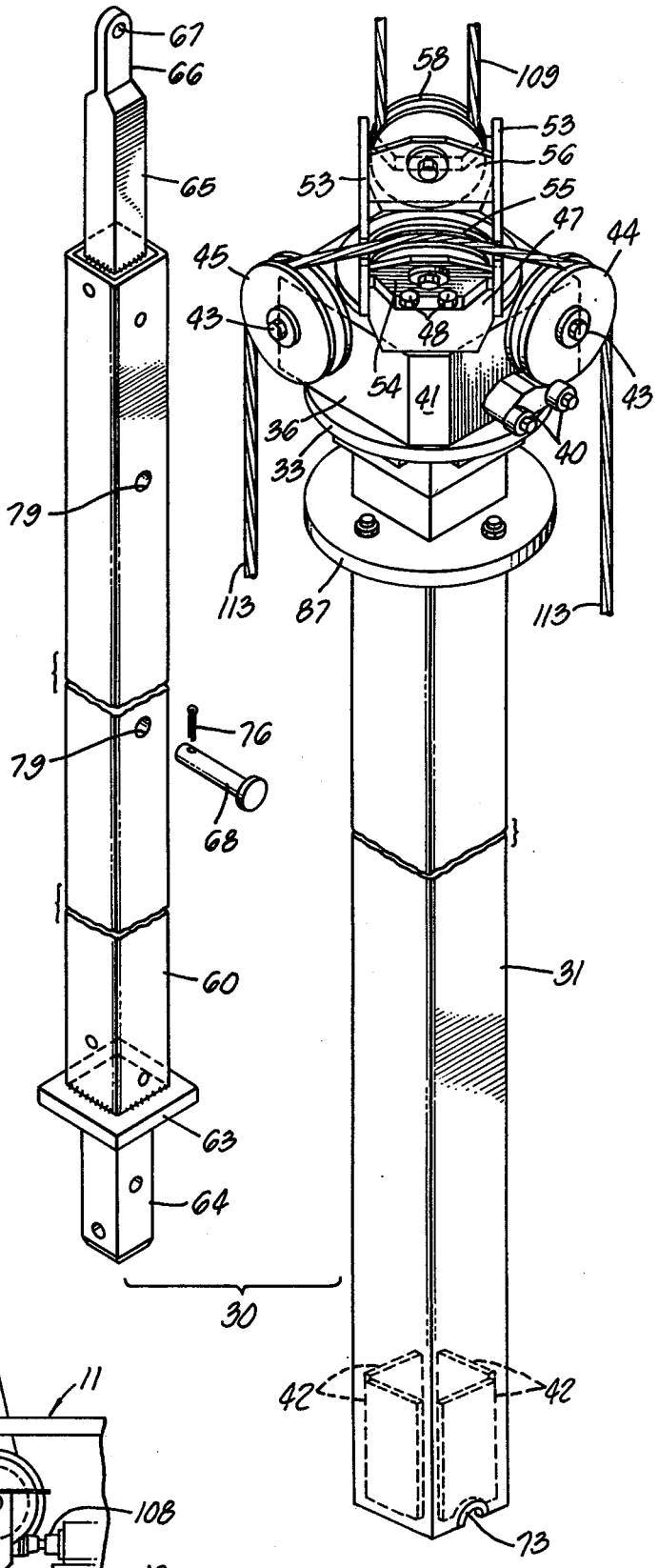
FIG. 2 is a perspective view of the inner and outer kelly members of the double kelly of the present invention when disassembled.

The derrick 18 has a drive kelly assembly 30 suspended in the longitudinal center thereof. As shown in FIG. 2, drive kelly assembly 30 includes an elongated square tubular outer kelly member 31 having attached on the upper end thereof a spindle 33. Spindle 33 is provided with a bottom portion having a square opening which fits over the square upper end of the outer kelly member 31 and is held on all four sides thereof by pin connectors 19 (FIGS. 19 and 20). As shown in FIG. 19, an inner raceway for tapered roller bearings 35 is formed on the outer surface of the spindle 33. The spindle 33 is mounted within a swivel head 36 which forms a cooperating outer raceway for the tapered roller bearings 35. Attached on opposite inner sides of the derrick 18 are longitudinal tracks 38 formed of square tubing. Mounted on opposite sides of the head 36 are pairs of spaced rollers 40 which straddle and are movable along the tracks 38. The rollers 40 prevent the head 36 from rotating while the outer kelly member 31, swivally supported thereby, is being rotated.

It should now be clearly understood that the spindle 33 which is attached to the upper end of the upper kelly member 31 is mounted so as to be able to rotate on the tapered roller bearings 35 within the head 36 while the head is being longitudinally raised or lowered within the derrick 18 by riding along the tracks 38.

Figure 23:
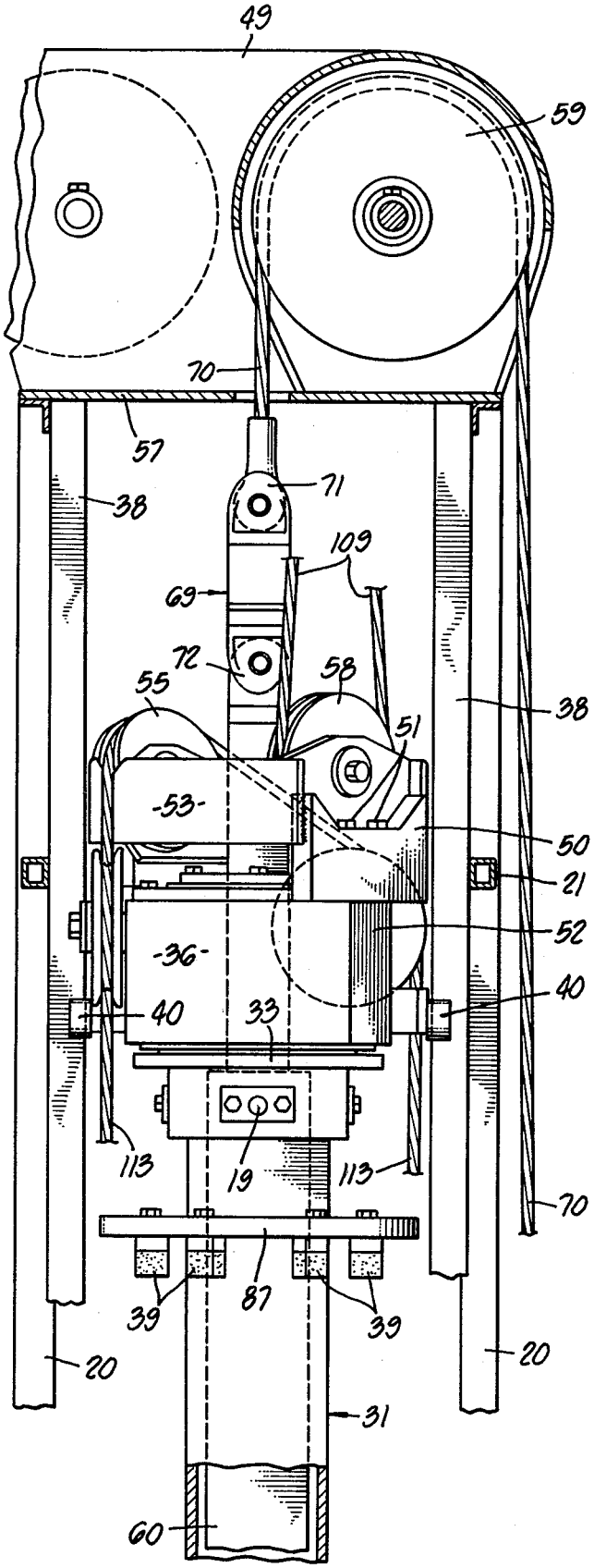
FIG. 23 is an elevation view of the swivel head on the outer kelly member and the pulley and cable arrangement for vertically raising and lowering the inner kelly member relative to the swivel head.
Figure 24:
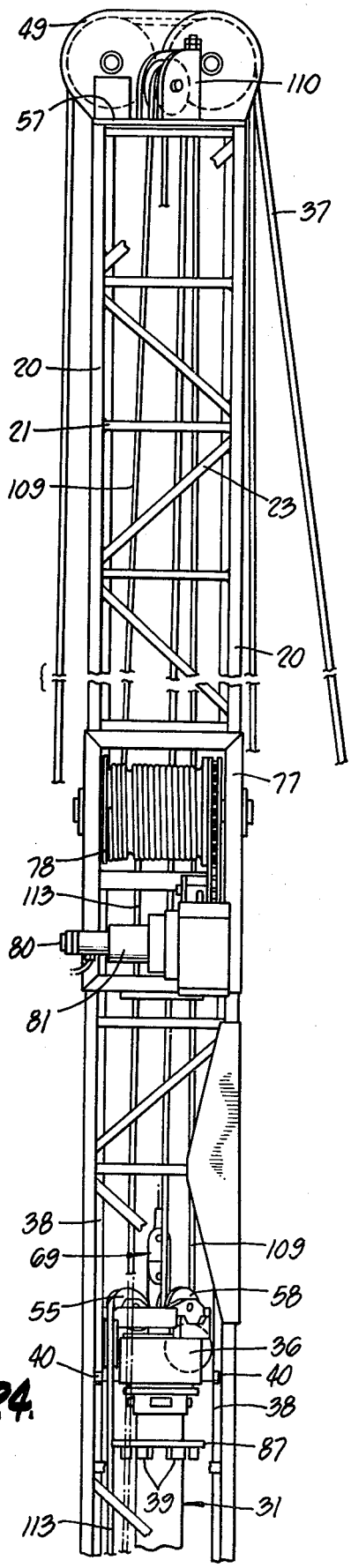
FIG. 24 is a view of the upper portion of the derrick showing the kelly head having been lowered downwardly from the upper end of the derrick.

As shown in FIG. 2, an upright plate 47 is attached by bolts 48 to the top of the front flattened corner 41 of head 36. As shown in FIG. 23, an identical upright plate 50 is attached by bolts 51 to the top of the opposite rear flattened corner 52 of head 36. A parallel pair of vertically disposed plates 53 are attached on the respective side edges of the upright plates 47 and 50. An angularly disposed support 54 for a crowd pulley 55 is held between the front ends of plates 53 (FIGS. 2 and 19). A vertically disposed support 56 for a hoist pulley 58 (FIG. 2) is held between the rear ends of plates 53. Rotatably mounted on pins 43 fixed in the distal ends of adjacent sides of head 36, i.e., so as to be arranged in perpendicular planes, are a pair of crowd pulleys 44 and 45. The arrangement of a hoist cable 109 on the hoist pulley 58 and a crowd cable 113 on the crowd pulleys 44, 55, and 45 will be described hereinafter.

Referring to FIG. 2, outer kelly member 31 has flat pads 42 provided on all four bottom side portions of the inner surfaces thereof. Extending upwardly so as to be telescopically received in the square tubular outer kelly member 31 is a square tubular inner kelly member 60. When so assembled, the square body of the inner kelly member 60 has a small clearance relative to the pads 42 on the inner surface of the outer kelly member. A square support plate 63 having sides which extend beyond the sides of the square body of the inner kelly member is welded to the bottom end thereof and an auger holder 64 having a square cross-section depends downwardly from the under side of the support plate 63. A support member 65 having a square cross-section is welded to the upper end of the body of the inner kelly member 60. The upper end of the support member 65 forms an attachment lug 66 having an opening 67 thereon.

Figures 9, 10:
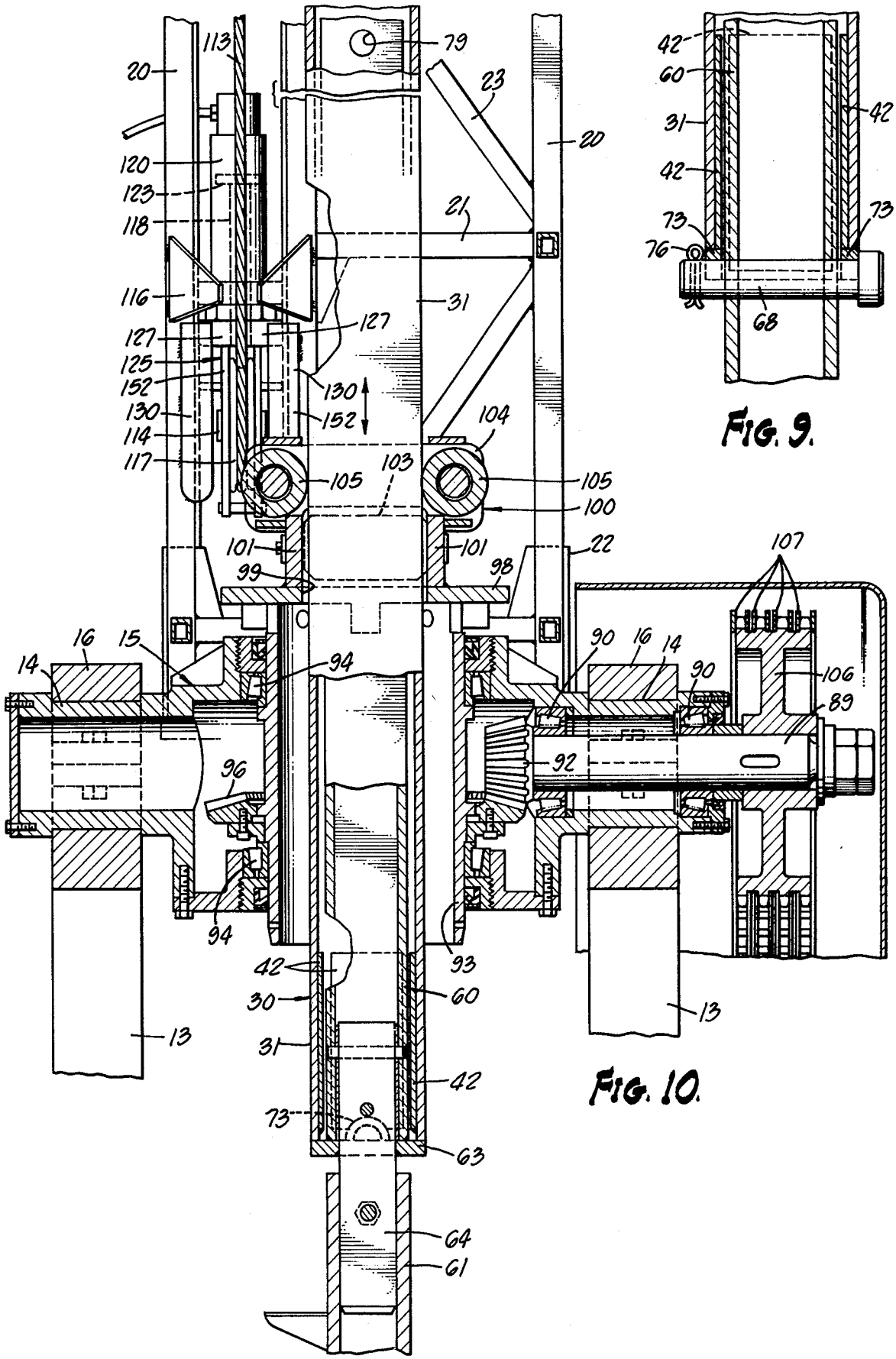
FIG. 9 is a cross-sectional view taken on the line 9—9 of FIG. 6 showing the bottom of the outer kelly member engaging the cross pin on the inner kelly member.
FIG. 10 is a vertical sectional view taken on the line 10—10 of FIG. 8A showing the rotary table housing assembly, the roller drive unit, and the drive kelly extending therethrough.
Figure 18:
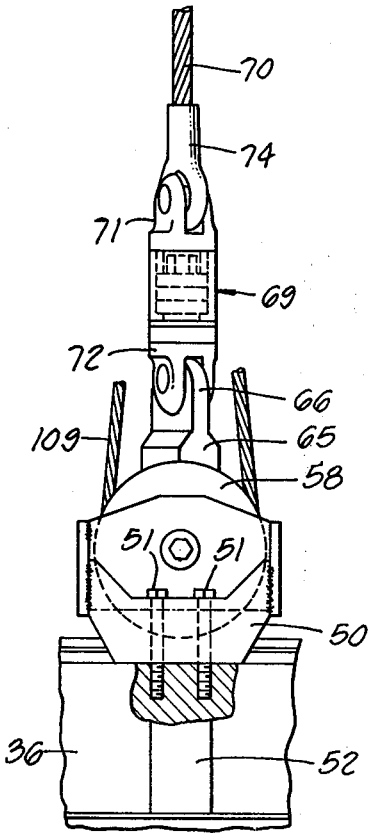
FIG. 18 is a view taken on line 18—18 of FIG. 17.
Figure 17:
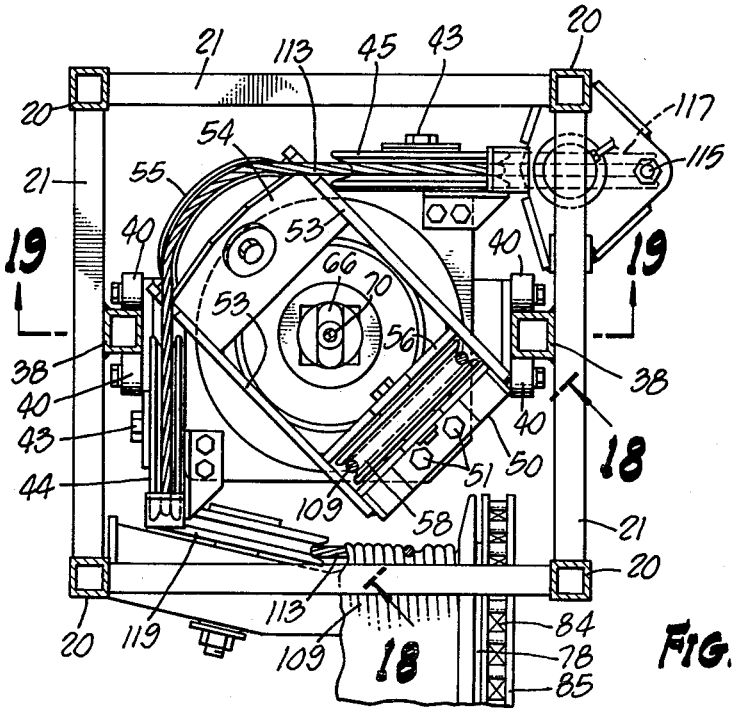
FIG. 17 is a plan view looking down on the swivel head of the drive kelly assembly taken on the line 17—17 of FIG. 8B.

Referring to FIGS. 18 and 19, when the inner kelly member 60 is in its uppermost position relative to the head 36, its support member 65 freely extends through a central opening 34 in the spindle 33. A ballbearing swivel connection 69 has a cap end 71 coupled to an eyelet 74 on the end of a hoist line 70 and a shank end 72 coupled to the attachment lug 66 of the inner kelly member 60. The ballbearing swivel connector permits the hoist line 70 and the inner kelly member 60 to freely rotate relative to each other. The body of the inner kelly member 60 is provided with holes 79 spaced along the length thereof. As shown in FIGS. 2 and 9, a cross pin 68 may be inserted in any of the bores 79 and retained in position by a cotter pin 76 passing through an opening in the end thereof.

The outer kelly member 31 has reinforcing semi-circular bearing members 73 welded in cutouts on the bottoms of opposite side walls thereof. The bearing members 73 on the bottom end of the outer kelly member 31 seat against the ends of the cross pin 68 inserted in one of the holes 79 of the inner kelly member 60 when a crowding force is applied on the head 36 of the drive kelly assembly 30, as will be described hereinafter.

Figure 3:
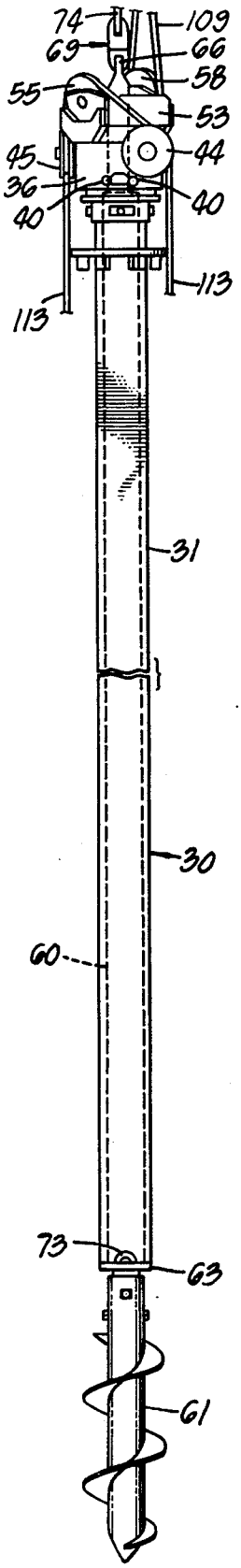
FIG. 3 shows the assembled inner and outer kelly members in their longitudinally collapsed position.

It should be noted that when the inner kelly member 60 is fully retracted, i.e., telescoped, within the outer kelly member 31, (FIG 3), the support plate 63 on the lower end of the inner kelly member 60 contacts the bottom of the outer kelly member 31. This enables the drive kelly assembly 30, including both the inner kelly member 60 and the outer kelly member 31 to be longitudinally raised or lowered within the derrick 18 as a unit by use of the hoist line 70.

As shown in FIGS. 1 and 21, the hoist line 70 extends over a pulley 59 mounted in a pulley frame 49 attached to the crown plate 57 provided on the top of the derrick 18 and down about a pulley 75 mounted on support plates 46 attached to the lower rear sides of the derrick 18 a short distance above the rotary table housing 15. From there the hoist line extends downwardly over to the main frame 11 where it is wound on a hoist drum 62 whose rotation is under manual control of the operator.

An auxiliary line 37 extends upwardly from the lower end of the derrick over pulleys 26 and 27 mounted on the pulley frame 49 attached to the top of the crown plate 57 (FIG. 21) and then extends downwardly to the main frame 11 where it is wound on an auxiliary drum 29 whose rotation is under manual control of the operator. The auxiliary line 37 is used for any utility hoisting requirements that may arise in the drilling operations.

Figure 8A:
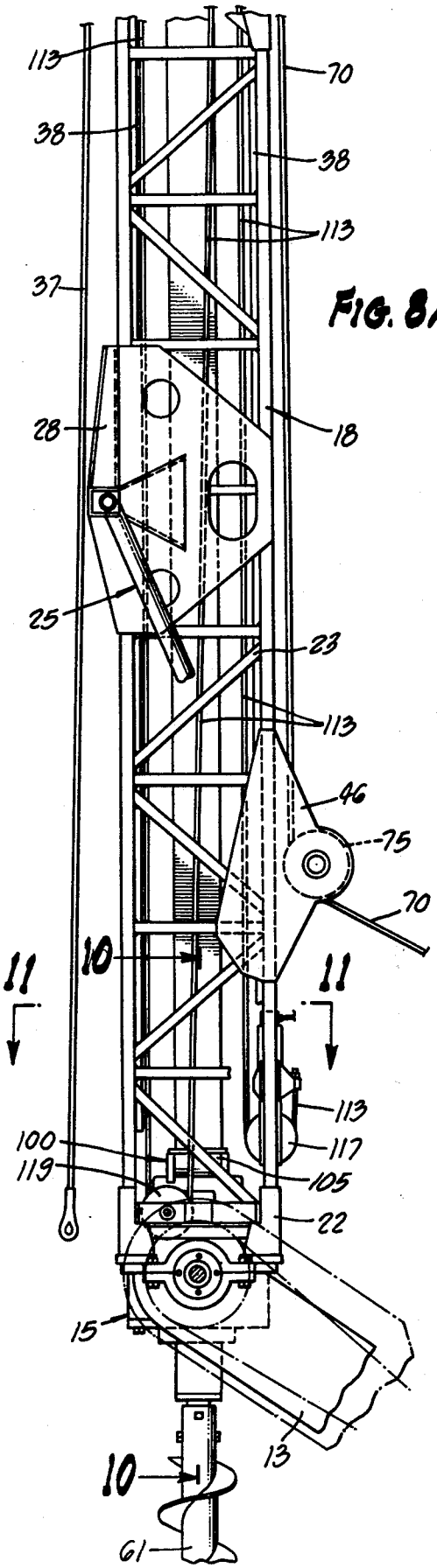
FIG. 8A is an enlarged side elevation view of the lower half portion of the vertical drilling rig shown in FIG. 1.
Figure 8B:
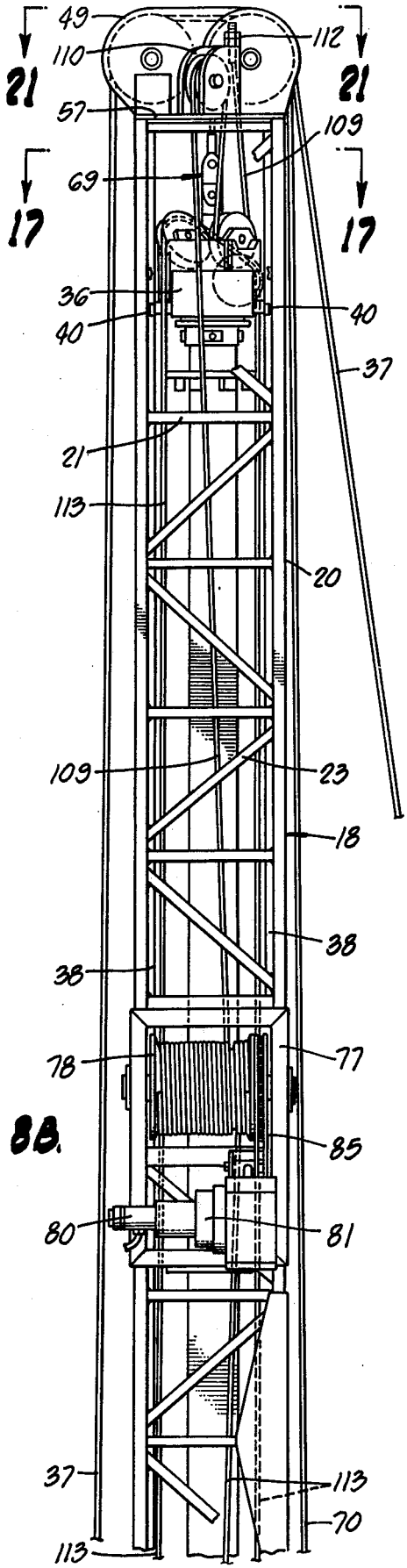
FIG. 8B is an enlarged side elevation view of the upper half portion of the vertical drilling rig shown in FIG. 1.
Figure 15:
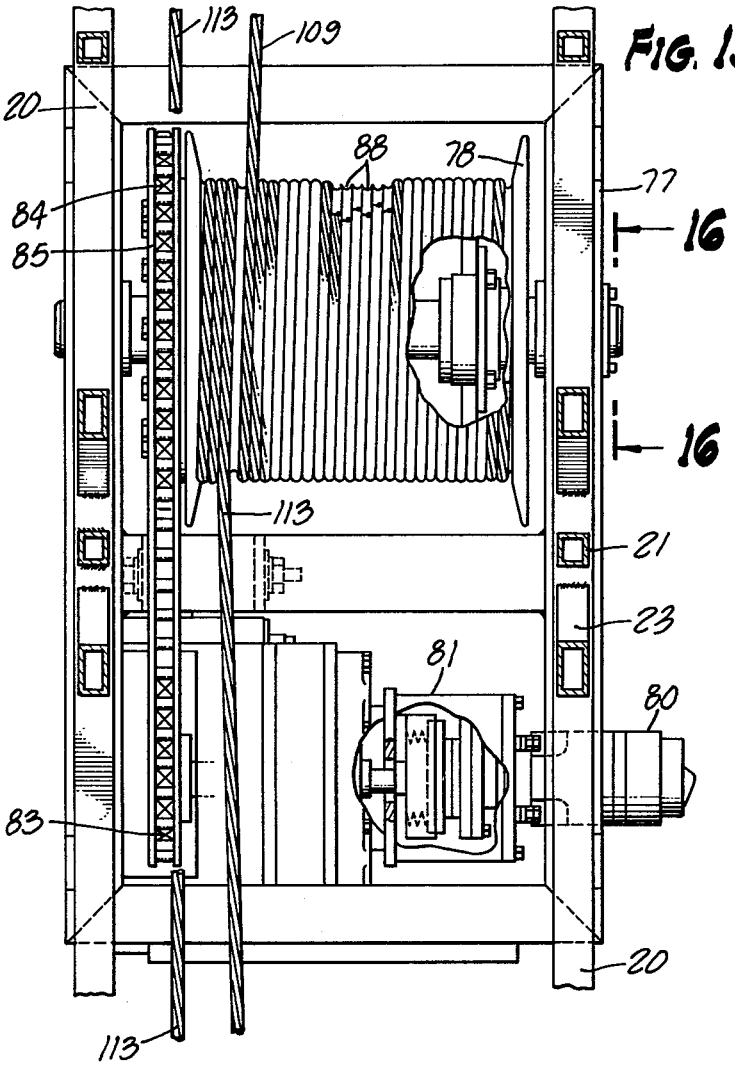
FIG. 15 is a view taken on line 15—15 of FIG. 7B showing the crowd drum assembly.
Figure 16:
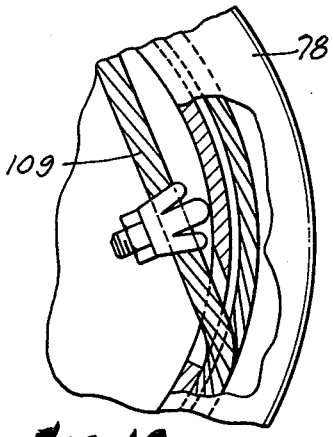
FIG. 16 is a detail taken on line 16—16 of FIG. 15.

As shown in FIGS. 1 and 8B, attached on the side of the derrick 18 approximately one-third of its length down from its crown plate 57 is a mount 77 for a crowd drum 78. Referring to FIG. 15, attached to mount 77 below the crowd drum 78 is a hydraulic motor 80 provided with a pressure-engaged, spring-release clutch 81. A driver sprocket 83 is provided on the end of the shaft of the hydraulic motor 80 and a driven sprocket 84 is provided on the end of the crowd drum 78. A chain 85 couples the sprockets 83 and 84 to drivingly rotate the crowd drum 78. As will be described hereinafter, the rotation of the hydraulic motor 80 in either direction about is shaft axis is under manual control of the operator.

Figure 7A:
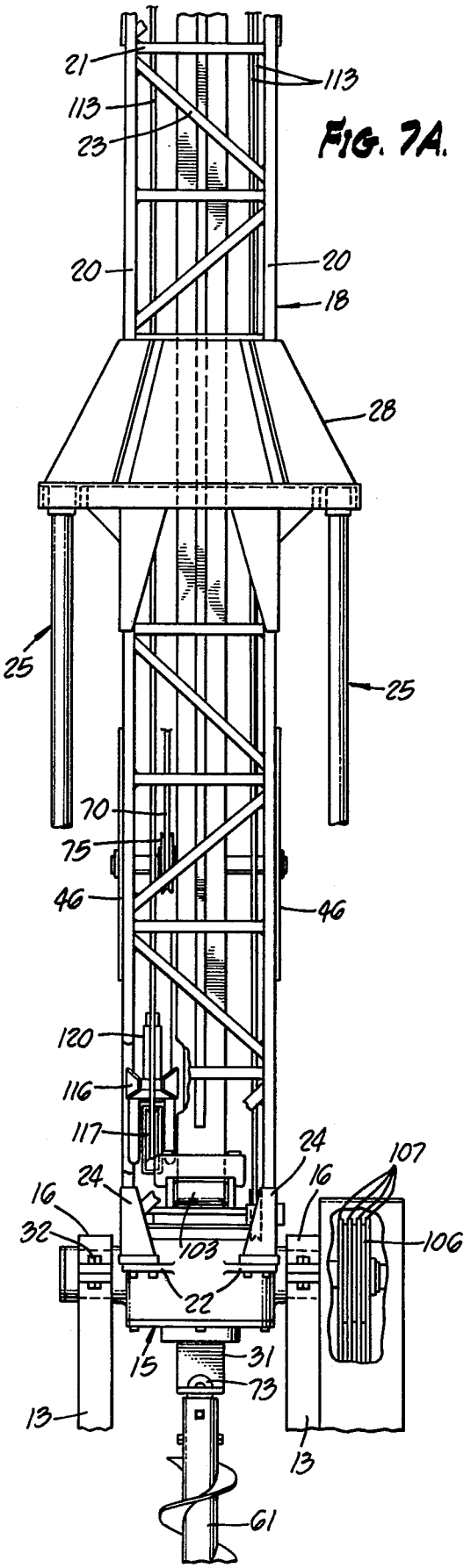
FIG. 7A is an enlarged front elevation view of the lower half portion of the vertical drilling rig shown in FIG. 1.
Figure 7B:
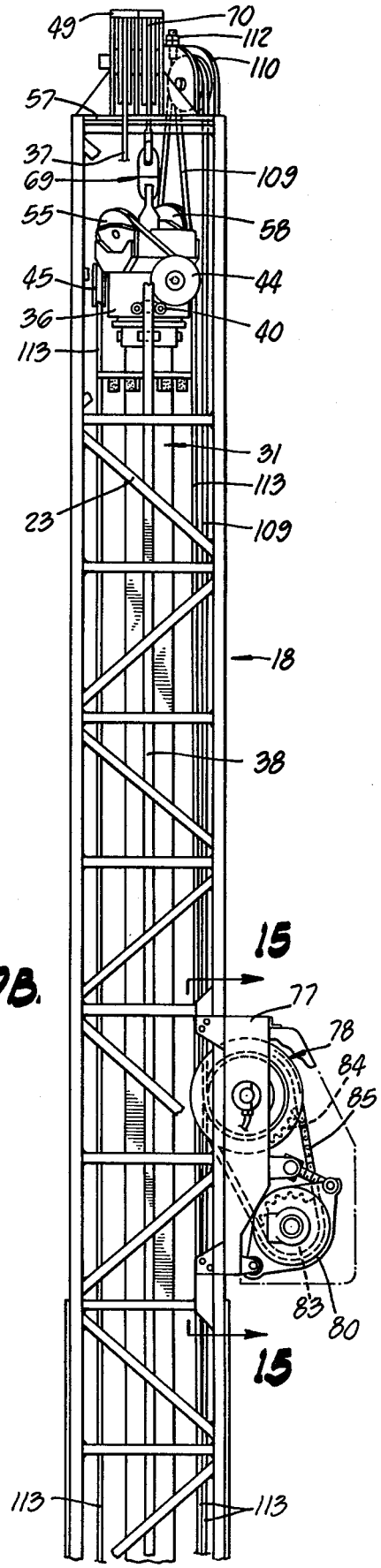
FIG. 7B is an enlarged front elevation view of the upper half portion of the vertical drilling rig as shown in FIG. 1.

As best shown in FIGS. 7A and 10, the rotary table housing 15 has ears 22 on the four corners thereof which are connected to foot connectors 24 on the bottoms of the four elongated corner members 20 of the derrick 18. The rotary table housing 15 has hollow trunnions 14 on opposite sides thereof. These trunnions may be pivotally supported in openings provided by clamps 16, attached by bolts 32, on the outer ends of the pair of arms 13 which are cantilevered from the main frame 10. A shaft 89 (FIG. 10) is rotatably mounted on tapered roller bearings 90 within one of the hollow trunnions 14. The inner end of the shaft 89 is provided with a pinion gear 92. A cylindrical member 93 is rotatably mounted and supported on upper and lower tapered roller bearings 94 within the rotary table housing 15. A spiral ring gear 96 is concentrically attached to the lower outer wall of the cylindrical member 93. The pinion gear 92 on the end of the shaft 89 engages the ring gear 96.

Referring to FIGS. 10 and 11, attached on the top of the cylindrical member 93 is a circular platform 98 provided with a square central opening 99 through which the outer kelly member 31 freely extends. Mounted on the platform 98 is a roller drive unit 100 through which the outer kelly member 13 extends. Roller drive unit 100 comprises a pair of spaced lower upright members 101 supporting a pair of rollers 103 which respectively engage a pair of opposite flat sides of the outer kelly member 31, and a pair of spaced upper upright members 104 supporting a pair of rollers 105 which respectively engage the other pair of opposite flat sides of the upper kelly member 31.

A sprocket 106 for four chains 107 is keyed on the outer end of shaft 89. The four chains 107 extend along arm 13 to a sprocket (not shown) mounted on the main frame 11. A rotary table clutch 102 (FIG. 1) on the main frame 11 is driven by a main drive shaft 108 of an engine (not shown) on the truck 17. The engaging of clutch 102 to drive the four chains 107 is under manual control of the operator.

It should now be clear that when the rotary table clutch 102 is engaged to drive the four chains 107, the cylindrical member 93 is rotated by ring gear 96. This causes the roller drive unit 100 to impart a rotary motion to the outer kelly member 31 which, in turn, rotates the inner kelly member 60 having the auger 61 attached to the holder 64 on the bottom end thereof. It should now be further clear that, while the outer kelly member 31 is thus rotated it is also able to move longitudinally in the derrick 18 relative to both the roller drive unit 100 and rotary table housing 15. As shown in FIG. 9, rubber bumpers 39 are provided on the bottom of a flange 87 which may be welded onto the upper end of the outer kelly member 31. When the drive kelly assembly 30 is in its lowermost position in the derrick the bumpers 39 will act as stops when they contact the top of the roller drive unit 100. The longitudinal movement of the outer kelly member in the derrick is equivalent to a vertical movement thereof.

Next to be described are the cable and pulley arrangements which provide for applying a crowd on the outer kelly member 31 when vertical force greater than the weight of the auger 61 and the kelly drive assembly 30 is needed to drill a hole in the earth.

Referring to FIG. 22, a hoist cable 109 has one end thereof fixedly connected by a connector 112 to the top of a pulley support 110 provided on the crown plate 57 of the derrick 18. The cable 109 extends downwardly from the crown plate 57 about the hoist pulley 58 attached to the head 36 and then upwardly to a pulley 111 mounted on the pulley support 110 and then extends downwardly to wind about the turns of the spiral groove 88 starting on one end of the crowd drum 78 mounted on the side of the derrick 18, FIG. 15. The cylindrical surface of the crowd drum 78 is formed with a spiral groove 88 along the length thereof whose turns enable the successive windings of the cable 109 to be evenly laid thereon and said out therefrom in an orderly fashion which will consistently prevent sudden cable releases or jams which might result from haphazard winding. Hoist cable 109 may be referred to as the first cable of the kelly crowd apparatus.

As shown in FIG. 12, a crowd cable 113 for crowding the outer kelly member 31 has one end connected by a connector 115 to a holder 116 which is attached near the lower end of the derrick 18 a short distance above rotary table housing 15. The crowd cable 113 extends down from holder 116 about a first pulley 117 having its axle 114 supported by the legs 152 of a clevis 125 (See FIG. 12).

The crowd cable 113, FIG. 2, then continues upward to engage about the crowd pulley 44 on the rear of one of the adjacent sides of the head 36 of the drive kelly assembly 30, continues over the angular oriented crowd pulley 55 on the top front corner of the head 36 and continues down to engage about the crowd pulley 45 on the rear of the other adjacent side of the head 36. The crowd cable 113 then continues on down to a second lower pulley 119, FIG. 8A, attached on the derrick 18 a short distance above the rotary table housing 15, and then extends up to wind on the turns of the spiral groove 88 on the surface of the drum 78 starting on the end thereof opposite from the end being used for winding the hoist cable 109 (FIG. 15). Crowd cable 113 may be referred to as the second cable of the kelly crowd apparatus.

The crowd drum 78 is of such a size that as the first or hoist cable 109 is payed out and the second or crowd cable is taken up, at least one turn of the spiral groove 88 formed on the surface of the crowd drum 78 is preferably left unused at all times by the windings of the respective cables. However, the drum can operate with portions of the windings of the respective cables adjacent to each other.

From the schematic illustration in FIG. 25, it will now become clear that, as the crowd drum 78 is being rotated in a clockwise direction by the hydraulic motor 80, the crowd cable 113 is being payed off the crowd drum 78. This permits the head 36 of the drive kelly assembly 30 to be raised in the derrick 18 by the hoist cable 109 which is simultaneously being taken up on the crowd drum. Thus the taking up of the hoist cable 109 by the drum 78 causes the portion thereof looped down about the pulley 58 to pull up on the head 36 and thus raise the outer kelly member 31 within the derrick 18.

On the other hand, as indicated by the schematic illustration in FIG. 26, as the crowd drum 78 is being rotated in a counterclockwise direction by the hydraulic motor 80, the hoist cable 109 is being payed off the crowd drum 78. This permits the head 36 of the drive kelly assembly 30 to be pulled down in the derrick 18 by the crowd cable 113 which is simultaneously taken up on the crowd drum. Thus the taking up of the crowd cable 113 causes the portion thereof looped about the pulleys 44, 55, and 45 to pull down on the head 36 and thus drive the auger 61 on the lower end of the inner kelly member 60 downwardly. This downward driving force is, of course, in addition to the weight of the parts of the kelly drive assembly 30.

Note that the providing of the hoist cable 109 on the drum 78, which is payed out at the same rate at which the crowd cable 113 is taken up on the drum, during "crowd down", assures that the rate of lowering the drive kelly asembly is sychronized with the rate of penetration of the auger 61 into the ground. This is important since the rate or penetration is a variable which cannot be controlled easily, if at all.

It is noted that the mountings of pulleys 44 and 45 on adjacent sides of the head 36 near diagonally opposite corners thereof together with the mounting of angularly disposed pulley 55 near the front top of the head provides for the crowd down cable exerting a downward crowd force F (FIGS. 4–6) across the diagonally opposite corners of the head. Note that such an arrangement not only provides a balanced load on the head but leaves the vertical opening in the center of the head unobstructed for passage of the hoist line 70 which is swivally connected to the inner kelly member 60.

Thus, if the hoist cable 109 were not provided and the formation of the ground being drilled becomes softer, the auger may, under its own weight and the weight of the drive kelly assembly, feed too fast and screw itself into the soil. This could cause the crowd cable 113 to become slack, i.e., not be held taut. Furthermore, if this were to occur, the hoist line 70 would likely not be able to pull the auger 61 with its cuttings from the hole. Thus the operator would have to take the time to reverse the rotation of the drive kelly, i.e., unscrew the auger 61 from the hole, and on the next cut reduce the rate of speed of the auger 61 so that it cuts all of the material from the hole wall as it progresses.

The hoist cable 109 thus helps to keep the crowd cable 113 taut so that the penetration rate automatically adjusts to the formation of the ground being drilled, and hence the overall operation of drilling is faster. The tautness or tension of crowd cable 113 is further assured by providing the cable tensioner pulley 117 which is described hereinafter.

A schematic diagram of the hydraulic drive and control system for operating the crowd kelly mechanism of the vertical drilling rig is illustrated in FIG. 25. As there shown, a hydraulic pump 121 supplies fluid from a reservoir 129 via a two-way, two-ported valve 122 in either direction through a main line loop 128 having the bidirectional hydraulic motor 80 connected therein. The fluid provided by the hydraulic pump 121 is regulated for use by the hydraulic motor 80 by being stored in accumulator 132. The regulation of the pump fluid is under the control of an unloading valve 133. The fluid from the pump 121 that passes through the motor control valve 122 into the main line 128 is fed to charge the gas filled bag-type accumulator 132 which is connected to the main line loop 128 at junction 91. When the pressure of the fluid charge in the accumulator 132 rises to a level of, for example, 1100 psi, the unloading valve 133, which is set to open at that level, causes the fluid supplied by pump 121 to be bypassed from the main line 128 through the valve 133 into the reservoir 129. A gauge 134 provides a reading of the pressure of the fluid charge in the accumulator.

It will now be understood that when the pressure of the fluid charge in the accumulator 132 reaches 1100 psi the unloading valve 133 opens up to start passing fluid from the pump 121 to the reservoir 129. When the pressure of the fluid charge in the accumulator 132 drops below 935 psi, the unloading valve 133 closes. Thus, the pressurized fluid in the main line 128 being fed to the motor 80 is effectively supplied by the charge in accumulator 132.

When the motor control valve 122 is in its neutral position as shown in FIG. 27, the fluid supplied by hydraulic pump 121 merely recirculates within the valve 122 back to the reservoir 129. When the motor control valve 122 is in its position shown in FIG. 25, as a result of the operator manually depressing the "crowd up" lever 138, the fluid in the main line 128, as regulated by the unloading valve 133, flows in such a direction as to rotate the hydraulic motor 80 in a clockwise direction. When the motor control valve 122 is in its opposite position shown in FIG. 26, as a result of the operator manually depressing the "crowd down" lever 139, the regulated fluid flows in the main line 128 in such a direction as to rotate the hydraulic motor 80 in the counterclockwise direction. Note that the "crowd up" lever 138 is spring loaded in its open position and must be held in its depressed position by the operator. On the other hand, the "crowd down" lever 139 can be self-held in its depressed position by detent 140.

A shuttle valve 124 connected in parallel across the hydraulic motor 80 senses the pressurized fluid in the main line 128 irrespective of its direction of flow and provides for feeding this pressurized fluid through control line 126 to a pressure reducing valve 147. Valve 147 supplies fluid at 100 psi, for example, on control line 131 to automatically engage the crowd clutch 81 whenever the motor 80 is energized. The engaging of crowd clutch 81 operates to connect the shaft of motor 80 to the driver sprocket 83 to drive the chain 85 coupled to the driven sprocket 84 on the crowd drum 78 (FIG. 15).

It should be understood that the crowd clutch 81 is normally spring loaded into its non-engaged position. It is only when the control line 131 is provided with a steady supply of reduced pressurized fluid from valve 147 that the fluid therein operates against the spring to engage the crowd clutch 81. When the control line 131 is no longer being supplied with a steady supply of pressurized fluid, the fluid left therein is bled through a restricting orifice 146 to the reservoir 129 thus depressurizing the line such that the spring on the crowd clutch 81 can operate to disengage it.

The crowd clutch 81 can be also separately controlled to be engaged by the operator manually depressing the lever 86 on a normally closed clutch valve 95 inserted in a control line 145 connected to the return side of the main line 128. See FIG. 27. The leading end of control line 145 is provided at all times with pressurized fluid from the pump. Thus the opening of clutch valve 95 by depressing its lever 86 supplies pressurized fluid through pressure reducing valve 147 to control line 131 for engaging the crowd clutch 81 even though the motor control valve 122 is closed and hydraulic motor 80 is not energized. The energizing of the clutch 81 by valve 95 results in a braking action on the crowd drum 78.

A pair of check valves 149 and 150 are provided in the main line 128, one on each side of the junction 91 for the accumulator 132. When motor control valve 122 is opened, pressurized fluid in the main line 128 is bled by pilot line 151 or 152, dependent upon the direction of the flow in the main line 128, to keep valve 150 or 149 open. However, when valve 122 is in its neutral position the check valves 149 and 150 are both closed because of lack of pressure in the pilot lines 151 and 152. The closing of both check valves 149 and 150 maintains the accumulator 132 charged at its high pressure. The closing of both check valves 149 and 150, as a result of returning the motor control valve 122 to its neutral position, also serves to instantly stop the hydraulic motor 80.

The rate of "crowd down", i.e., the rate of penetration of the auger 61 at a constant crowd load, as provided by the rate of rotation of the crowd drum 78 by the hydraulic motor 80 can be controlled by the operator by manually varying the setting of a flow control valve 137 provided in the main line 128. It is noted that a check valve 135 is connected in parallel across the valve 137 such that the restriction of the flow of fluid in the main line as provided by the valve 137 is effective during "crowd down" only, that is, when fluid flow is to the right at this point in the main line 128, as shown in FIG. 26. This is because check valve 135 forces the fluid to flow through the valve 137. Note that fluid flowing to the left at this point in the main line 128, as shown in FIG. 25, is able to flow through the check valve 135 and thus bypasses the valve 137. By such an arrangement, crowding up of the head 36 of the kelly drive assembly 30 can be accomplished at a very fast rate at all times.

It should be evident that with a constant crowd force on the auger 61, as provided by the hydraulic system illustrated in FIG. 26, when the formation of the earth becomes harder, the vertical rate of penetration of the auger is automatically slowed down, and when the formation of the earth becomes softer, the vertical rate of penetration of the auger is automatically increased. Thus, the hydraulic crowding mechanism of the present invention provides a constant crowd force with a variable vertical penetration rate of the auger 61.

It should be understood that a characteristic of the hydraulic motor 80 is that its rate of rotation is proportional to the rate of flow of the pressure regulated fluid supplied by the accumulator 132. Thus, when the resistance of the formation being drilled by the rotating auger 61 gets harder, the vertical penetration rate thereof, and therefore the rate of rotation of the hydraulic motor, slows down. When this occurs, the rate of flow of the pressure regulated fluid from the accumulator 132 to the motor slows down, accordingly.

It is noted that tension is provided on the crowd cable 113 at all times during the operation of the drilling rig by providing for movably supporting the first lower pulley 117 on the end of the piston rod 118 (see FIGS. 10, 12 and 26). Fluid from the main line 128 is fed via a check valve 144 to a control line 143 connected to a cylinder 120 enclosing the piston 123. The piston rod 118 is attached to the top of the clevis 125 whose legs 152 (FIG. 12) are connected to bear down on the axle 114 of the pulley 117. The legs 152 of clevis 125 are guided in their movement by side projections 127 (FIG. 10) which slide in key ways formed by the guide members 130 attached to the derrick 18. Thus, as shown in FIGS. 25 and 26, the fluid in the main line 128 is fed to the cylinder 120 to bear against the piston 123 and cause the piston rod 118 to push down on the axle 114 of the pulley 117 to take up any slack in the crowd cable 113 during operation of the drilling rig. A lever 154 of a tension release valve 142 can be depressed when desired, such as at the end of the day, to remove pressurized fluid from the control line 143 which is isolated from the main line 128 by check valve 144.

OPERATION

It is desirable for the fast efficient operation of the vertical drilling rig that the constant crowd force applied on the head 36 of the drive kelly assembly 30 have the maximum downward vertical travel rate permitted by the hardness of the formation of the earth encountered at any given instant during the drilling of a hole.

Figure 4:
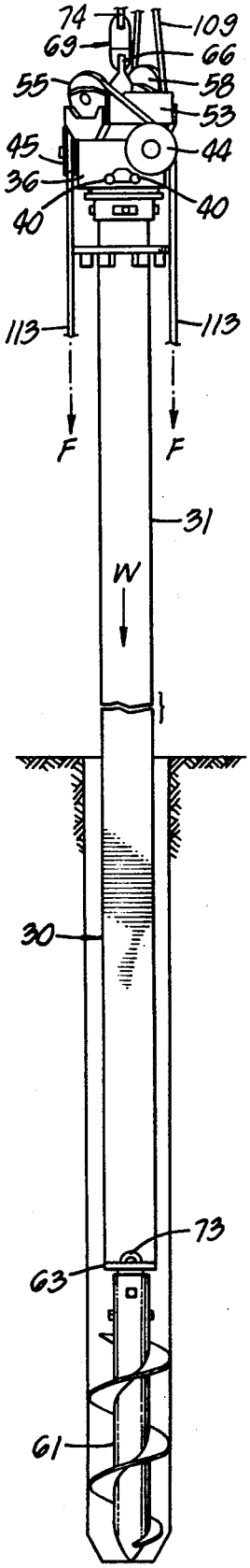
FIG. 4 shows the inner and outer kelly members in their longitudinally collapsed position being used to drill a hole.

In normal operation, gravity, i.e., the combined weight W of the drive kelly and the auger 61 is sufficient to drive the rotating auger 61 into the ground (FIG. 4). However, upon contacting harder formations, as indicated by reference numeral 82 in FIGS. 5 and 6, the gravitational force of this equipment may not be enough to advance the auger 61. Accordingly, the kelly crowd mechanism of the present invention is brought into operation in these instances by the operator to apply an additional constant downward force F on the outer kelly member 31 which is then transmitted to the inner kelly member 60 and, therefore, the auger 61.

Figure 5:
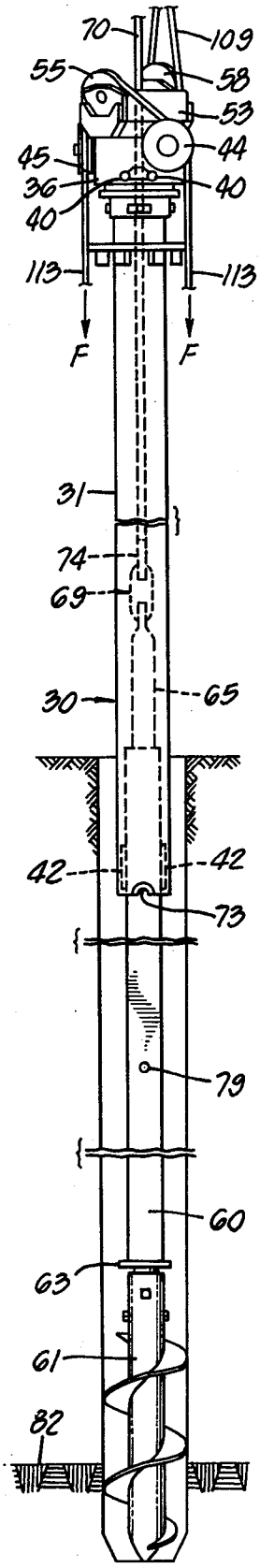
FIG. 5 shows the inner and outer kelly members in their longitudinally extended position being used to drill a hole with the aid of friction crowding.
Figure 6:
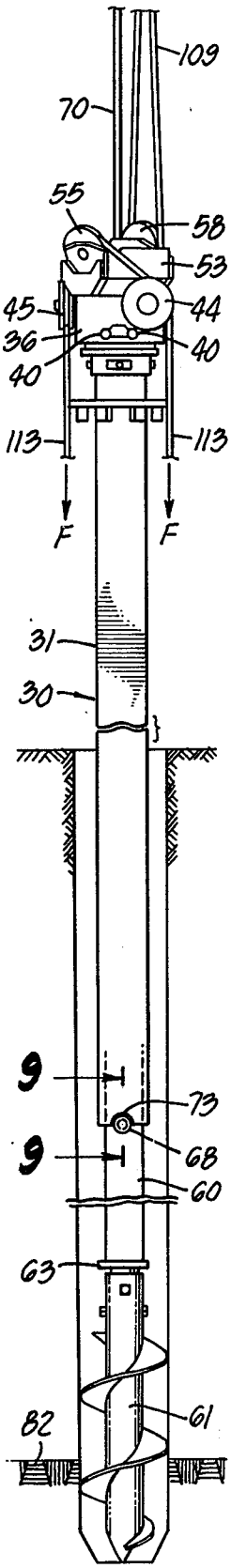
FIG. 6 shows the inner and outer kelly members in their longitudinally extended position with the bottom end of the outer kelly member being fixed to the upper end of the inner kelly member to enable the kelly members to be used to drill a hole with the aid of positive crowding.

There are two conditions under which the kelly crowd mechanism of the present drilling rig can operate. In one condition, the inner kelly member 60 is fully retracted, i.e., telescoped into the outer kelly member 31 and the full crowd force is thus transferred directly to the inner kelly member 60. This is schematically illustrated by the dashed arrows F on the ends of the crowd cable 113 of FIG. 4. In the other condition the inner kelly member 60 is extended and the crowd force is transferred to the inner kelly member 60 by either (a) friction between the inner and outer kelly members 60 and 31 as illustrated in FIG. 5, or (b) by exerting the crowd force on the crowd pin 68 inserted across the inner kelly member 60 below the bottom of the outer kelly member 31, as illustrated in FIG. 6.

To use the friction crowd, the drive kelly assembly 30 is first raised up by use of the hoist line 70 such that the auger 61 clears the hole being drilled thereby. This raising of the drive kelly assembly 30 may be the result of the normal operation of raising it to remove the cuttings from the auger 61. Note that during this time the crowd clutch 81 is disengaged so that the crowd drum 78 rotates freely.

By use of the hoist line 70, the drive kelly assembly 30, including the inner kelly member 60 and the outer kelly member 31, is then lowered toward the hole being cut. The movement of the drive kelly assembly 30 in the derrick is stopped when the head 36 is several feet above the rotary drive housing 15. The lever 86 on the crowd clutch valve 95 is then depressed to engage the crowd clutch 81, thus braking the crowd drum 78.

While the outer kelly member 31 is thus held in a fixed position, by use of the hoist line 70 the inner kelly member 60 is lowered, i.e., telescoped out of the outer kelly member 31 until the auger 61 contacts the bottom of the hole being drilled in the ground. Alternatively, the inner kelly member 60 with the outer kelly member 31 supported thereby can be lowered to the bottom of the hole being drilled and the outer kelly member 31 can then be raised relative to the inner kelly member 60 by depressing the "crowd up" lever 138 on valve 122. The rotary drive unit 100 is then engaged by use of the rotary table clutch 102 to rotate the outer kelly member 31 and therefore the inner kelly member 60 having the auger 61 on the bottom thereof. This rotation of the outer kelly member 31 provides torque thereon which causes the pads 42 on the lower end thereof to contact the walls of the inner kelly member 60 and develop friction therebetween.

Then, with the hoist line 70 unbraked, the "crowd down" lever 139 on the motor control valve 122 is depressed to start the "crowd down" force. Thus, the outer kelly member 31 is moving downwardly relative to the inner kelly member 60 to frictionally transmit its downward movement to the auger 61. Note that the "crowd down" lever 139 is indicated in FIG. 26 as being provided with a detent 140 to hold it in its depressed position as the crowd force is being frictionally applied. This is of advantage since the advancing of the auger 61 is relatively slow.

If the crowd force created by friction is not enough to force the auger 61 into the earth, the outer kelly member 31 will slip on the inner kelly member 60 and the crowd pin 68 will have to be used.

To crowd with the crowd pin 68, the drive kelly assembly 30 is raised up by the hoist line 70 to a position in which the lower end of the outer kelly member 31 is accessible above the hole being drilled in the ground. The crowd clutch lever 86 is then depressed to engage clutch 81 and thereby hold the outer kelly member 31 while the inner kelly member 60 is lowered by use of the hoist line 70 until the first hole 79 thereon is exposed below the lower end of the outer kelly member 31. Alternatively, the inner kelly member can be held by hoist line 70 as the outer kelly member 31 is raised relative to the inner kelly member 60 by depressing the "crowd up" 138 on the motor control valve 122. The crowd pin 68 is then installed in one of the holes 79 on the lower end of the inner kelly member. The inner kelly member 60 is then raised by the hoist line until the pin 68 just contacts the reinforcing members 73 on the bottom of the outer kelly member 31. By use of the hoist line 70, the inner and outer kelly members are then lowered until the auger 61 hits the bottom of the hole being drilled in the earth. Then, with the hoist line 70 unbraked, the "crowd down" lever 139 on the motor control valve 122 is depressed to start the "crowd down" force.

It should be noted that when using a positive crowd the inner kelly member 60 with the auger 61 on the lower end thereof is held in its extended position relative to the outer kelly member 31 by the crowd pin 68. The kelly members 31 and 60 are therefore effectively locked to move together when subjected to a crowd force. Thus, under this condition, the outer kelly member can be crowded down even though the outer kelly member is not rotating and developing a torque therebetween. If the rotation of auger 61 happens to stall during "crowd down" the operator can momentarily depress the "crowd up" lever 138 on motor control valve 122 to relieve the downward crowding pressure so that the auger will start rotating again.

To drill deep holes, each time the auger 61 is lifted out of the hole by the hoist line 70 to remove the cuttings therefrom, the outer kelly member 31 is held in its raised position by use of the crowd clutch lever 86. The inner kelly member 60 is then lowered by the hoist line 70 to expose the next high hole 79 thereon. The crowd pin 68 is then removed from the lower hole 79 and replaced on this next higher hole 79 on the inner kelly member 60.

It should now be clearly understood that in the course of the drilling of a hole in the earth with a drilling rig utilizing a kelly drive on the auger, the hardness of the formation encountered by the auger frequently varies considerably. In accordance with the present invention, the regulated pressure of fluid charge in the accumulator 132 operates through the hydraulic motor 80 and the crowd cable 113 to provide a substantially constant crowd force on the auger 61. The constant crowd force meets a variable resistance due to the variation of the hardness of the formation of the earth being drilled by the auger 61 which automatically adjusts the penetration rate of the auger 61. Thus, when the formation encountered becomes harder the penetration rate of the auger automatically slows down and when the formation encountered becomes softer the penetration rate automatically speeds up.

It should be noted that the flow control valve 137 provided in the main line 28 can be adjusted to modify the penetration rate of the auger for a given constant crowd load thereon. The valve 137 may be adjusted, for example, to provide a crowd rate of penetration in soft soil which is substantially equal to the penetration of the auger without any crowd force.

Normally the flow control valve 137 is opened up to permit the penetration rate of the auger to be as fast as permissible since this assures that the hole will be drilled in the least amount of time. However, there are times when the soil is so soft that the auger penetrates too fast with the constant crowd force, i.e., the auger runs away. At such times the flow control valve 137 is adjusted to slow down the penetration rate of the auger by slowing down the rate at which fluid is delivered from accumulator 132 to the hydraulic motor 80. This effectively slows down the rate of rotation response to the motor 80 and therefore the rotation of the drum 78 which takes up the crowd cable 113 that produces the "crowd down" force.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. In a vertical drilling rig, a kelly crowd mechanism comprising in combination:

a drive kelly;

a crowd drum having a cable thereon which is drivingly coupled to crowd down said drive kelly when taken up on said drum;

a hydraulic motor;

a normally disengaged clutch operable to couple said motor to said drum in response to pressurized fluid;

a pressure regulated source of fluid;

a motor control valve manually operable to gate pressurized fluid supplied by said source to rotate said hydraulic motor and simultaneously engage said clutch to thereby rotate said crowd drum and thereby crowd down said drive kelly; and a clutch control valve manually operable to gate pressurized fluid supplied by said source to engage said clutch and apply a brake to said crowd drum when said motor control valve is closed.

2. In a vertical drilling rig, a kelly crowd comprising the combination:

a derrick;

a drive kelly having on its upper end a swivel head movable longitudinally in said derrick and having a drilling tool supported from the lower end thereof;

a rotatable drum;

a first cable on said drum, said first cable coupled to said swivel head and said derrick to permit said drive kelly to be lowered relative to said derrick when said drum rotates in a given direction and to raise said drive kelly relative to said derrick when said drum rotates in the opposite direction;

a second cable on said drum, said second cable coupled to said swivel head and said derrick to crowd down said drive kelly relative to said derrick when said drum rotates in said given direction and to permit said drive kelly to be raised relative to said derrick when said drum rotates in said opposite direction;

a main hydraulic line;

a bi-directional hydraulic motor connected in the main hydraulic line and coupled to rotate said crowd drum;

a source of pressure regulated fluid;

a motor control valve capable of being positioned to supply fluid from said source to flow in either direction through said main hydraulic line and cause said hydraulic motor to rotate in said given direction or said opposite direction; and a flow control valve in said main line, said flow control valve being settable to control the rate of the flow of fluid from the source to the hydraulic motor to modify the rate of rotation of the latter.

3. In a vertical drilling machine a kelly crowd apparatus comprising in combination:

a derrick;

an upper fixed pulley near the top and a lower fixed pulley near the bottom of said derrick;

a drive kelly having a swivel head which is movable longitudinally within said derrick;

means for rotating said drive kelly;

a pair of said pulleys, an angularly disposed pulley, and a vertically disposed pulley on said swivel head;

a rotatable drum mounted on the middle portion of said derrick;

a first cable having one end connected near the top of said derrick and extending down about the vertically disposed pulley on said swivel head and up about the upper fixed pulley on said derrick and then down to wind about said drum in one sense;

a second cable having one end connected near the bottom of said derrick and extending up about one of the side pulleys, across the angularly disposed pulley, over the other of the side pulleys on said swivel head, down about the fixed lower pulley on said derrick, and then up to wind about said drum in the other sense; and means for rotating said drum in a direction which provides for paying out the first cable to permit the swivel head of said drive kelly to be lowered in said derrick and for simultaneously taking up the second cable to apply a downward force on said swivel head and thereby crowd down the drive kelly.

4. In the art of drilling a hole in the surface of the earth by means of a rotating auger supported from a drilling rig, the method of crowding the rotating auger downward comprising:

drivingly coupling a hydraulic motor between the rig and auger so that as the motor rotates the auger moves downward relative to the rig, and supplying fluid at a regulated pressure level to said motor to drivingly rotate the same and thereby apply a substantially constant crowd force on said auger even though the penetration rate of said auger varies in accordance with the vertical resistance of the formation of the earth being drilled.

5. In the art of drilling a hole in the surface of the earth by means of a rotating auger supported from a drilling rig, the method of crowding the rotating auger downward comprising:

providing a hydraulic motor having a rate of rotation that is substantially directly proportional to the rate of flow of fluid therethrough, drivingly coupling the motor between the rig and the auger so that rotation of the motor crowds the auger downward relative to the rig, providing a source of hydraulic fluid having a regulated substantially constant pressure level, and supplying fluid from the source to flow through the motor to provide a constant crowd force on the auger, whereby the variation of the hardness of the formation of the earth encountered by the auger serves to vary the rate of rotation of the motor and accordingly vary the rate of fluid supplied by the source to the motor.

6. In a vertical drilling rig including a vertically movable swivel head having a drive kelly rotatably suspended therefrom, said swivel head being of generally square horizontal cross-sectional configuration and having a central vertical opening therethrough, and a kelly hoist line extending through said opening, means for crowding the drive kelly downwardly comprising:

a pair of mutually perpendicular side pulleys mounted in vertical planes on respectively adjacent sides of said swivel head, the side pulleys being located near diagonally opposite corners of said swivel head;

an angularly disposed, partly vertical and partly horizontal pulley mounted near the top of said swivel head, intermediate said two side pulleys and spaced away from said kelly hoist line;

a cable looped over said angularly disposed pulley and having end portions disposed about respective ones of said side pulleys so as to extend downwardly at diagonally opposite corners of said swivel head; and means for applying a downward force on the end portions of said cable;

whereby a balanced crowd down force is applied to said swivel head.

7. In a vertical drilling rig, a kelly crowd apparatus comprising, an upright derrick;

a drive kelly having a swivel head on the upper end of said drive kelly and vertically movable in said derrick, an outer kelly member swivelly suspended from said swivel head and having bearing means located on the lower edge of said outer kelly member, and an inner kelly member telescopically received within said outer kelly member and having at least one pair of coaxially aligned bores in said inner kelly member, said bores being coaxially alignable with said bearing means;

a hoist line swivelly coupled to the upper end of said inner kelly member;

a drilling tool fastenable to the lower end of said inner kelly member;

means for rotating said drive kelly;

a rotatable drum mounted on said derrick;

a first cable on said drum and coupled between said swivel head and said derrick to raise said drive kelly relative to said derrick when said drum rotates in one direction;

a second cable on said drum and coupled between said swivel head and said derrick to crowd down said drive kelly relative to said derrick when said drum rotates in the opposite direction;

means for rotating said drum; and pin means selectively locatable in said bores for abutment with said bearing means when said drum rotates in said opposition direction.

8. In a vertical drilling rig, a kelly crowd apparatus comprising in combination:

an upright derrick;

a drive kelly having on its upper end a swivel head movable vertically in said derrick and having supported from its lower end a drilling tool;

means for rotating said drive kelly;

a rotatable drum mounted on the derrick;

a first cable on said drum, said first cable coupled between said swivel head and said derrick to permit said drive kelly to be lowered relative to said derrick when said drum rotates in one direction and to raise said drive kelly relative to said derrick when said drum rotates in the opposite direction;

a second cable on said drum, said second cable coupled between said swivel head and said derrick to crowd down said drive kelly relative to said derrick when said drum rotates in one direction and to permit said drive kelly to be raised relative to said derrick when said drum rotates in said opposite direction; and means for rotating said drum in either direction including a bi-directional hydraulic motor; and a source of pressure-regulated fluid connected to flow through said motor, including, a pump;

a bag-type accumulator charged with fluid supplied by said pump; and an unloading valve means operable in response to the pressure of the fluid charge in the accumulator to unload the fluid being supplied by the pump to the accumulator when the pressure in the latter reaches a predetermined value.

9. In a vertical drilling rig, a kelly crowd apparatus comprising in combination:

an upright derrick;

a drive kelly having on its upper end a swivel head movable vertically in said derrick and having supported from its lower end a drilling tool;

means for rotating said drive kelly;

a rotatable drum mounted on the derrick;

a first cable on said drum, said first cable coupled between said swivel head and said derrick to permit said drive kelly to be lowered relative to said derrick when said drum rotates in one direction and to raise said drive kelly relative to said derrick when said drum rotates in the opposite direction;

a second cable on said drum, said second cable coupled between said swivel head and said derrick to crowd down said drive kelly relative to said derrick when said drum rotates in one direction and to permit said drive kelly to be raised relative to said derrick when said drum rotates in the opposite direction;

means for rotating said drum in either direction; and means, powered by said drum rotating means, for taking up any slack in said second cable by imposing a tension-generating force thereon.

10. In a vertical drilling rig having a drive kelly rotatably suspended from a swivel head, a kelly crowd apparatus comprising:

a cable, means for supporting said cable in a loop, means for securing a swivel head to said loop near the mid-point thereof, means for selectively driving said cable in opposite directions to selectively raise and lower said swivel head securing means, and means, actuated by said driving means, for taking any slack out of said cable loop by exerting a tensioning force thereon.

11. The drilling rig of claim 10 including a swivel head comprising means for exerting an axially directed crowd down force from said cable thereonto including a first cable-receiving pully adjacent one extremity of said swivel head, a second cable-receiving pully adjacent an opposite extremity of said swivel head and oriented so as to be in a plane which is substantially perpendicular to a plane including said first pully, and a third cable-receiving pully intermediate said first and second pulleys and oriented so as to be in a plane which angularly intersects the planes including said first and second pulleys, said cable being arranged so as to pass over said first pulley, then across said third pulley, and then over said second pulley in the formation of said cable loop.

12. The drilling rig of claim 10 wherein said driving means includes an hydraulic motor having a rotation rate substantially directly proportional to the rate of fluid flow therethrough, an hydraulic fluid source, and means for delivering fluid from said source to said motor at a pressure regulated to produce a substantially constant crowd force.

13. The drilling rig of claim 12 wherein said driving means further includes rotatable drum means drivable by said motor, and said drum means includes a spiral groove extending about the periphery of said drum means from one end thereof to the other, said groove being so sized as to seatingly receive said cable therein for accurate laying on and paying out of said cable during rotation of said drum.

* * * * *